United States Patent [19]

Rosen

[11] Patent Number: 4,689,449

[45] Date of Patent: Aug. 25, 1987

[54] TREMOR SUPPRESSING HAND CONTROLS

[75] Inventor: Michael J. Rosen, Arlington, Mass.

[73] Assignee: Massachusetts Institute of Technology, Cambridge, Mass.

[21] Appl. No.: 915,230

[22] Filed: Oct. 3, 1986

[51] Int. Cl.[4] ..... H01H 25/00; H01C 10/10

[52] U.S. Cl. ..... 200/6 A; 338/98; 338/128

[58] Field of Search ..... 200/6 A, 153 K; 338/128–131, 98, 132; 464/180, 181; 128/739

[56] References Cited

U.S. PATENT DOCUMENTS

| | | | |
|---|---|---|---|
| 2,627,560 | 2/1953 | Eitel | 200/6 A X |
| 2,841,659 | 7/1958 | Eitel | 200/6 A X |
| 2,842,645 | 7/1958 | Dalgleish et al. | 338/128 |
| 3,550,466 | 12/1970 | Ham | 200/6 A X |
| 3,613,813 | 10/1971 | Biddle et al. | 200/6 A X |
| 3,707,093 | 12/1972 | Worden | 200/6 A X |
| 4,520,242 | 5/1985 | Kopsho | 200/6 A |
| 4,533,899 | 8/1985 | Isaksson | 200/6 A X |

FOREIGN PATENT DOCUMENTS 0152380 8/1985 European Pat. Off. .

OTHER PUBLICATIONS

Rosen, et al., *Proceedings—1979 International Conference on Rehabilitation Engineering,* "A Damped Joystick: Adaptive Control for the Tremor-Disabled," pp. 74–79, 1979.

Laffey "The Use of a Mechanically Damped Joystick as a Means of Reducing Intention Tremor," pp. 1–75, 1985.

*Primary Examiner*—J. R. Scott

*Attorney, Agent, or Firm*—James E. Maslow; Thomas J. Engellenner

[57] ABSTRACT

A hand control capable of suppressing tremors and other unwanted vibrations is disclosed which incorporates viscous damping in two degrees of freedom to mechanically filter the forces applied by the user's hand. To suppress pathological intention tremors, the damping characteristics are chosen so as to selectively reduce the amplitude of movements at or above about 3 Hertz. The hand control includes a chamber filled with a viscous fluid, a position-sensing actuator assembly and a damping element connected to the actuator and disposed within the chamber to suppress involuntary movements of the actuator. The volume of the chamber, size of the damping element and viscosity of the fluid are chosen to achieve a damping constant of about 2 to 20 lbf-sec/ft., preferably from about 5 to about 15 lbf-sec/ft. The viscous fluid is preferably a silicone oil having a viscosity of about 300,000 to about 900,000 cstokes.

11 Claims, 2 Drawing Figures

TREMOR SUPPRESSING HAND CONTROLS

BACKGROUND OF THE INVENTION

The U.S. Government has rights in this invention pursuant to National Institute of Health Grant No. NS-17610.

The technical field of this invention is hand controls which generate electrical signals in response to movement of an operator-actuated handle and, in particular, hand controls which damp involuntary tremors or other vibrations during use.

A common form of pathological tremor is known as intention tremor and is characterized by random, oscillatory muscle activity superimposed upon intended motion during the performance of voluntary acts. In severe cases, the amplitude of intention tremor can be so great as to obscure the desired motion. It is estimated that almost one million people in the United States alone are affected by intention tremor.

Those who rely upon automated wheelchairs and similar vehicles for mobility are particularly troubled by intention tremor. Conventional hand controls for electrically powered wheelchairs are ill-suited for disabled persons who also suffer from tremors. Such controls typically translate the user's tremors into random and unwanted wheelchair motion, causing fatigue, frustration and, sometimes, danger to the user.

There exists a need for better hand control mechanisms for those afflicted with intention tremor. Hand control mechanisms which could ease the operation of wheelchairs and other vehicles would satisfy a long-felt need in the field. Even among the able-bodied population, control interfaces which could suppress tremors or other unwanted vibrations would improve performance of a wide variety of manually controlled operations.

SUMMARY OF THE INVENTION

A hand control capable of suppressing tremors and other unwanted vibrations is disclosed which incorporates viscous damping in two degrees of freedom to mechanically filter the forces applied by the user's hand. To suppress pathological intention tremors, the damping characteristics are chosen so as to selectively reduce the amplitude of movements at or above about 3 Hertz.

In one preferred embodiment, the hand control includes a chamber filled with a viscous fluid, a position-sensing actuator assembly and a damping element connected to the actuator and disposed within the chamber to suppress involuntary movements of the actuator. In the illustrated embodiments, the damping element is a spherical ball. The volume of the chamber, size of the ball and viscosity of the fluid are chosen to achieve a damping constant in the range of about 2 to 20 lbf-sec/ft., preferably from about 5 to about 15 lbf-sec/ft. The viscous fluid is preferably a silicone oil having a viscosity preferably of about 100,000 to about 900,000 cstokes, more preferably, of about 400,000 to about 700,000 cstokes.

The position sensing actuator assembly can be formed, for example, by connecting the actuator handle via yokes to a pair of orthogonally positioned potentiometers. As the handle is moved, it moves the yokes with it. The yokes are attached to the potentiometers such that any movement of the yokes results in a change in the resistance of the potentiometers.

For wheelchair control as well as other applications, the hand control mechanism can also include a fast stop mechanism which allows the damping to be bypassed.

In an illustrated embodiment, a control button is incorporated into the actuator handle which must be depressed for handle movement to be effective (e.g., in producing wheelchair movement); unless the user depresses the button, the motor is not engaged. Conversely, when the button is released, the wheelchair automatically comes to a halt.

The hand control position sensors (or the subsequent signal processing circuitry) can also include a dead zone in which motion of the actuator is not translated into changes in output signal. Such a zone about the center area of handle movement is preferred to eliminate spurious movements of the vehicle or other controlled system when the user accidentally or unintentionally displaces the handle slightly from its upright (or other null point) centering position. In some instances, this dead zone can eliminate the need for centering (return) springs.

The invention will next be described in connection with certain illustrated embodiments. However, it should be clear that various changes, additions and subtractions can be made by those skilled in the art without departing from the spirit or scope of the invention. For example, although the invention is described principally in connection with wheelchair operations, it should be clear that the hand controls can also be adapted to meet other needs of tremor-disabled persons. Devices according to the present teachings can be applied to the control of computer screen cursors, hand operated communication devices, home appliances, etc.

Additionally, the present invention can also be applied to suppress involuntary motions by even the able bodied operator of a hand control. In delicate or dangerous, remote-control situations, hand controls according to the present invention can be employed to reduce the possibility of mishap. Surgical instruments, robot arms, and various other delicate devices can benefit from the present teachings. Moreover, the invention can also be used to suppress jolts and other spurious external vibrations, for example, in rough terrain vehicles, airplanes and other similar applications.

DETAILED DESCRIPTION

Figure 1:
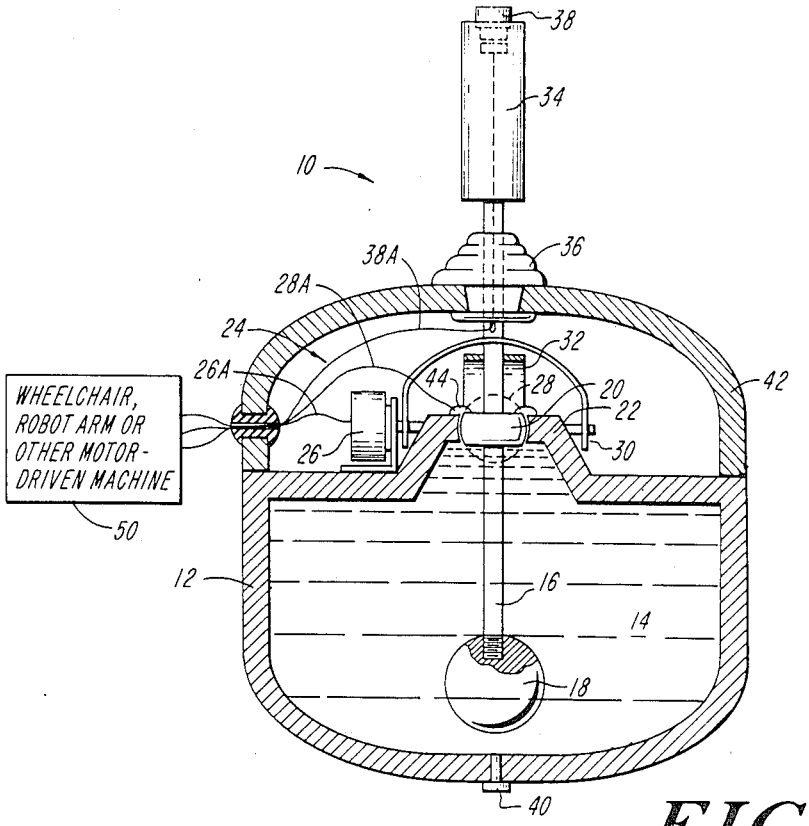
FIG. 1 is a cross-sectional side view of a hand control according to the present invention.

In FIG. 1, a hand control 10 is shown having a chamber 12 filled with a viscous fluid 14, such as silicone grease (e.g., Dow Corning 200 fluid —600,000 cstokes). Disposed within the fluid is a shaft 16 carrying a drag element 18 which cooperates with the fluid 14 to damp displacements of shaft 16. The drag element is preferably a sphere in order to achieve equal damping action in all directions as it moves through the fluid. For a chamber approximately 5 inches in diameter, the spherical drag element can be about $\frac{3}{4}$ to 1 inch in diameter.

The shaft 16 is coupled to the chamber 12 via a spherical (or partially spherical) pivot element 20 and a cooperating annular socket 22. The pivoting ball element 20 and the socket 22 include mating surfaces which allow the shaft to move freely (e.g., through about 30 degrees) in each of two degrees of freedom. A boot or low friction seal 44 can also be incorporated between the upper surface of the socket 22 and pivoting element 20 to prevent fluid leakage should the device be oriented in a direction other than upright and to exclude dirt from the pivoting ball and socket joint. Handle 34 is disposed on the upper end of shaft 16 to allow the user to pivot the shaft 16.

Activation switch 38 is incorporated into handle 34 to control movement of the motor-driven machine 50. A boot or other hermetic seal 36 can be employed to exclude dirt from the position sensing mechanism 24. A plug 40 can be incorporated for filling and draining the chamber 12.

An upper casing 42 is disposed above the chamber 12 to define a housing for a position sensing mechanism 24. In the illustrated embodiment, the position sensing mechanism includes a first potentiometer 26 and a second potentiometer 28 having first and second input shafts, respectively, positioned orthogonally to each other.

Wires 26A, 28A and 38A, from first potentiometer 26, second potentiometer 28 and activation switch 38, respectively, provide directional and control signals for the motor driven machine 50.

Figure 2:
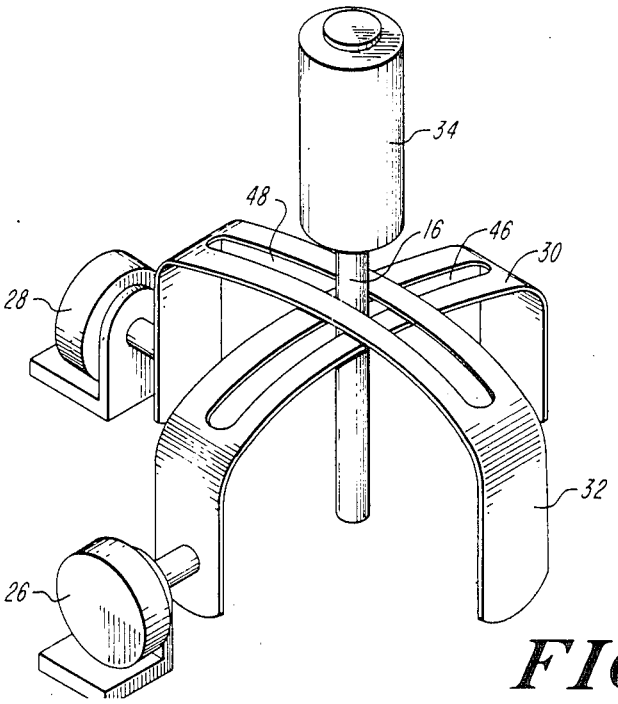
FIG. 2 is a more detailed isometric view of the position sensing mechanism of the hand control of FIG. 1.

In FIG. 2, the position-sensing mechanism is shown in more detail, including the first and second potentiometers 26, 28 coupled to the shaft 16 by the first and second orthogonal yokes 30, 32, respectively. Each of the yokes 30, 32 includes a longitudinal slot 46, 48 through which the shaft passes. The yokes are mounted to independently pivot with movement of the shaft 16. Movement of the yokes 30, 32 results in changes of the resistance of the potentiometers 26, 28 via rotation of their input shafts. Return springs (not shown) can also be incorporated to bias the handle and return it to a reference point.

In the illustrated embodiments, the reference point is dead center upright and any movement therefrom results in a varied electrical resistance exhibited by the first and second potentiometers 26, 28. The combination of such signals allows the user to provide a full range of movement control instructions in two dimensions (e.g., forward and backward, left and right).

It should be appreciated, however, that hand controls according to the present invention need not be restricted to upright applications. The device can be oriented such that the null point for the shaft may be horizontal or at any other angle, including upside down from the illustrated embodiment, so long as the boot or seal 44 is adequate to prevent fluid leakage.

Regardless of the orientation of the dead center reference point, it may be preferable to incorporate a dead zone about the reference point to eliminate unintended deviations from zero output when the user accidently or unintentionally displaces the handle through a small angle as well as when the device does not incorporate return springs or the like. Such a dead zone can be accomplished by non-linear resistance elements in the potentiometers 26, 28 so that slight rotations of the input shafts do not change their resistance. Alternatively, processing of the potentiometer signals with threshold sensing can achieve the same dead zone effect.

It should also be appreciated that the yoke and potentiometer mechanism can be replaced by alternative structures. For example, four or more on-off push button switches disposed about the shaft can be employed such that displacement of the shaft activates one or more of the buttons. Such a mechanism would also incorporate a dead zone, insofar as a finite displacement from the reference position is necessary in order to cause the switches to close.

The hand control described above can have a diameter of about 4.5 inches, a height of 6.5 inches, and can weigh under 3 pounds. It is ideally suited for control of electric wheelchair motors to convert the user's hand motions into directional control signals. However, the hand controls disclosed herein can also be used in the control of vehicles generally, such as motorized vans, rough terrain vehicles, aircraft, flight simulators and the like. Hand controls according to the present invention can also be used to facilitate fine control of robot arms, particularly in delicate or dangerous, remote control applications. Devices along the lines of those disclosed herein may also find use in controlling the direction of endoscopes and catheters during surgery or medical diagnosis, as well as controlling X-Y translation stages for semiconductor device fabrication operations and the like.

What is claimed is:

1. A hand control device capable of suppressing vibrations during operation by a user, the device comprising:

a handle adapted to be held by the user;

a chamber filled with a viscous fluid;

a shaft connected to said handle at one end and disposed within the fluid of the chamber at the other end, the shaft further including a drag element which cooperates with the fluid to damp spurious motion; and position-sensing means disposed about the shaft for sensing the position of shaft relative to a reference point and for generating electrical signals indicative of said position; said position-sensing means including at least a first sensing element and a second sensing element which are activated by said shaft during operation to generate electrical signals when said shaft is displaced from said reference point.

2. The device of claim 1 wherein drag element and the fluid cooperate to achieve a damping constant of about 2 to about 20 lbf-sec/ft.

3. The device of claim 1 wherein drag element and the fluid cooperate to achieve a damping constant of about 5 to about 15 lbf-sec/ft.

4. The device of claim 1 wherein the position sensing means further comprises first and second orthogonally positioned potentiometers coupled to the shaft such that displacement of the shaft rotates one or both of the potentiometers.

5. The device of claim 1 wherein the position sensing means further includes means for defining a dead zone in which displacement of the shaft relative to the reference point does not result in a change in the electrical signals.

6. The device of claim 1 wherein the device further comprises an activation switch connected to a motor-driven machine to control the operation of the motor and the position sensing means is also connected to said machine such that the electrical signals generated by said position sensing means control directional movement of said machine, said directional movement not occurring unless said activation switch is activated by the user.

7. The device of claim 6 wherein the motor driven machine is a vehicle.

8. The device of claim 7 wherein the vehicle is a wheelchair.

9. The device of claim 6 wherein the motor driven machine is a robot arm.

10. The device of claim 1 wherein the drag element disposed within the fluid filled chamber comprises a spherical ball.

11. The device of claim 1 wherein the viscous fluid comprises a silicone oil having viscosity ranging from about 100,000 to about 900,000 cstokes.

* * * * *